US006219863B1

(12) United States Patent
Loberg et al.

(10) Patent No.: US 6,219,863 B1
(45) Date of Patent: Apr. 24, 2001

(54) SUPPORT STRUCTURES AND METHODS OF FABRICATING SUPPORT STRUCTURES

(76) Inventors: Dwayne D. Loberg, Box 153, Dewinton, Alberta (CA), T0L 0X0; Walter M. Viveiros, 68 Lynnwood Dr. SE., Calgary, Alberta (CA), T2C 0S6

( * ) Notice: Subject to any disclaimer, the term of this patent is extended or adjusted under 35 U.S.C. 154(b) by 0 days.

(21) Appl. No.: 09/516,712

(22) Filed: Mar. 1, 2000

Related U.S. Application Data

(63) Continuation of application No. 09/066,135, filed on Apr. 24, 1998, now abandoned.

(51) Int. Cl.[7] ..... A47C 23/06

(52) U.S. Cl. ..... 5/236.1; 5/238; 5/200.1; 5/201; 5/613; 5/618

(58) Field of Search ..... 5/236.1, 237, 238, 5/200.1, 201, 202, 282.1, 285, 286, 613, 616, 617, 618

(56) References Cited

U.S. PATENT DOCUMENTS

| | | | | |
|---|---|---|---|---|
| 3,061,843 | * | 11/1962 | Singer et al. | 5/618 |
| 3,921,230 | * | 11/1975 | Hanning et al. | 5/616 |
| 4,567,615 | * | 2/1986 | Fanti | 5/238 |
| 4,589,151 | * | 5/1986 | Behrens | 5/618 X |
| 4,752,981 | * | 6/1988 | Salens | 5/238 |
| 5,916,086 | * | 6/1999 | Rossdeutscher | 5/236.1 |
| 5,926,872 | * | 7/1999 | Rossdeutscher | 5/236.1 |

FOREIGN PATENT DOCUMENTS

| | | | | |
|---|---|---|---|---|
| 3101215 | * | 8/1982 | (DE) | 5/236.1 |
| 0397069 | * | 11/1990 | (EP) | 5/236.1 |
| 2563096 | * | 10/1985 | (FR) | 5/236.1 |

* cited by examiner

*Primary Examiner*—Terry Lee Melius
*Assistant Examiner*—James M. Hewitt
(74) *Attorney, Agent, or Firm*—Parsons & Goltry; Robert A. Parsons; Michael W. Goltry

(57) ABSTRACT

An assembly, including a first support structure having a first removable support member and a set of first slats supported for receiving and supporting a first body supporting element, a second support structure having a second removable support member and a set of second slats supported for receiving and supporting a second body supporting element, with the first and second removable support members removed, a connector assembly engagable with the first and second sets of slats and with the first and second support structures, the connector assembly and the first and second sets of slats for receiving and supporting a body supporting element different from the first and second body supporting elements.

8 Claims, 5 Drawing Sheets

20
21
22
23
24
26
27
30
31
32
33
34
40
41
42
43
50
65

SUPPORT STRUCTURES AND METHODS OF FABRICATING SUPPORT STRUCTURES

CROSS REFERENCE TO RELATED APPLICATION

This application is a continuation, of application Ser. No. 09/066,135, filed Apr. 24, 1998, now abandoned.

FIELD OF THE INVENTION

This invention relates generally to the field of support structures and, more particularly, to a support structure and fabrication methods for support structures of a type for supporting the human body.

BACKGROUND OF THE INVENTION

For human beings, sleep is essential for sustaining physical and emotional health. Due to the essential importance of sleep in this regard, the prior art is replete with an array of apparatus and systems for not only promoting restful sleep, but also providing comfortable and, in some instances, therapeutic rest. Various mattress, box spring and support structure designs for supporting a sleeping surface are but few of the vast array of available sleep related features that have enjoyed considerable innovation throughout recent years.

Although much has been done to the structure of mattresses, box springs and structures for supporting mattresses and/or box springs, little attention has been devoted toward modular sleeping systems operative for only decreasing the high cost commonly associated with conventional frame and mattress sleeping systems, but also accommodating specific consumer needs of adaptability and convertibility of a sleeping assembly. The foregoing and other deficiencies inherent in the art therefore necessitate new and useful improvements.

Accordingly, it would be highly desirable to provide new and improved support structures and fabrication methods for support structures of a type for supporting a human body for sleep and/or rest.

It is a purpose of the present invention to provide a new and improved support structure that is easy to construct.

It is another purpose of the present invention to provide a new and improved support structure that may be converted into one or more of a plurality of body supporting orientations.

It is still another purpose of the present invention to reduce substantially the high costs associated with conventional frame and mattress sleeping systems.

It is a further purpose of the present invention to provide a new and improved support structure that is inexpensive.

It is yet a further purpose of the present invention to accommodate consumer sleeping and rest needs.

It is still a further purpose of the present invention to provide a new and improved modular sleeping system.

SUMMARY OF THE INVENTION

The above problems and others are at least partially solved and the above purposes and others are realized in a new and improved support assembly and fabrication method for a support assembly of a type for supporting the human body. In a specific embodiment, the support assembly is generally comprised of a first support structure including a first framework having first free ends and a first support member removably coupled with the first free ends, and a first plurality of slats supported by the first framework at first and second ends thereof, the first plurality of slats for receiving and supporting a first body supporting element having a supporting surface, one of the first and second ends of each one of the first plurality of slats removably coupled with the first removable support member. Further included is a second support structure including a second framework having second free ends and a second support member removably coupled with the second free ends, and a second plurality of slats supported by the second framework in series at first and second ends thereof, the second plurality of slats for receiving and supporting a second body supporting element having a supporting surface, one of the first and second ends of each one of the second plurality of slats removably coupled with the second removable support member.

Consistent with the foregoing, with the first and second removable support members removed from the first and second free ends and one of the first and second ends of each one of the first and second plurality of slats, further provided is a connector assembly engagable with one of the first and second ends of each one of the first and second plurality of slats and with the first and second free ends. In this regard, the connector assembly and the first and second plurality of slats operate to receive and support a selected body supporting element having a supporting surface greater than the supporting surface of each of the first and second body supporting elements.

In a specific embodiment, the connector assembly may include an elongate support structure having ends, means for detachably securing the ends of the elongate support structure with the first and second free ends of the first and second frameworks, and means for removably coupling one of the first and second ends of each one of the first and second plurality of slats with the elongate support structure intermediate the ends thereof.

In a further embodiment, the present invention may also include an adjustable support assembly. In this regard, and with one of the first and second plurality of slats removed from one of the first and second frameworks, the adjustable support assembly may be removably engaged with the one of the first and second frameworks, the adjustable support assembly for receiving and supporting an adjustable body supporting element and movable between a lowered orientation and an elevated orientation. In a particular embodiment, the adjustable support assembly may a linkage assembly removably engagable with the one of the first and second frameworks intermediate first and second ends thereof, the linkage assembly being movable between a lowered orientation and an elevated orientation and directed toward one of the first and second ends of the one of the first and second frameworks. Further included is a motor for moving the linkage assembly between the lowered orientation and the elevated orientation.

In another embodiment, the adjustable support assembly may still further include another linkage assembly removably engagable with the one of the first and second frameworks intermediate first and second ends thereof, the linkage assembly being movable between a lowered orientation and an elevated orientation and directed toward the other one of the first and second ends of the one of the first and second frameworks. The motor previously disclosed, or another motor if desired, may be employed for moving the other linkage assembly between the lowered and elevated orientations.

Consistent with the foregoing, associated methods may also be provided.

BRIEF DESCRIPTION OF THE DRAWINGS

The foregoing and further and more specific objects and advantages of the instant invention will become readily apparent to those skilled in the art from the following detailed description thereof taken in conjunction with the drawings in which.

DETAILED DESCRIPTION OF A PREFERRED EMBODIMENT

The present invention provides, among other things, a new and improved support assembly and methods of fabricating one or more support assemblies of a type for supporting the human body for rest and/or sleep. The invention incorporates a modular infrastructure for allowing selected construction of the support assembly in a plurality of body supporting orientations for providing flexibility, adaptability and consumer flexibility.

Figures 1, 2, 3:
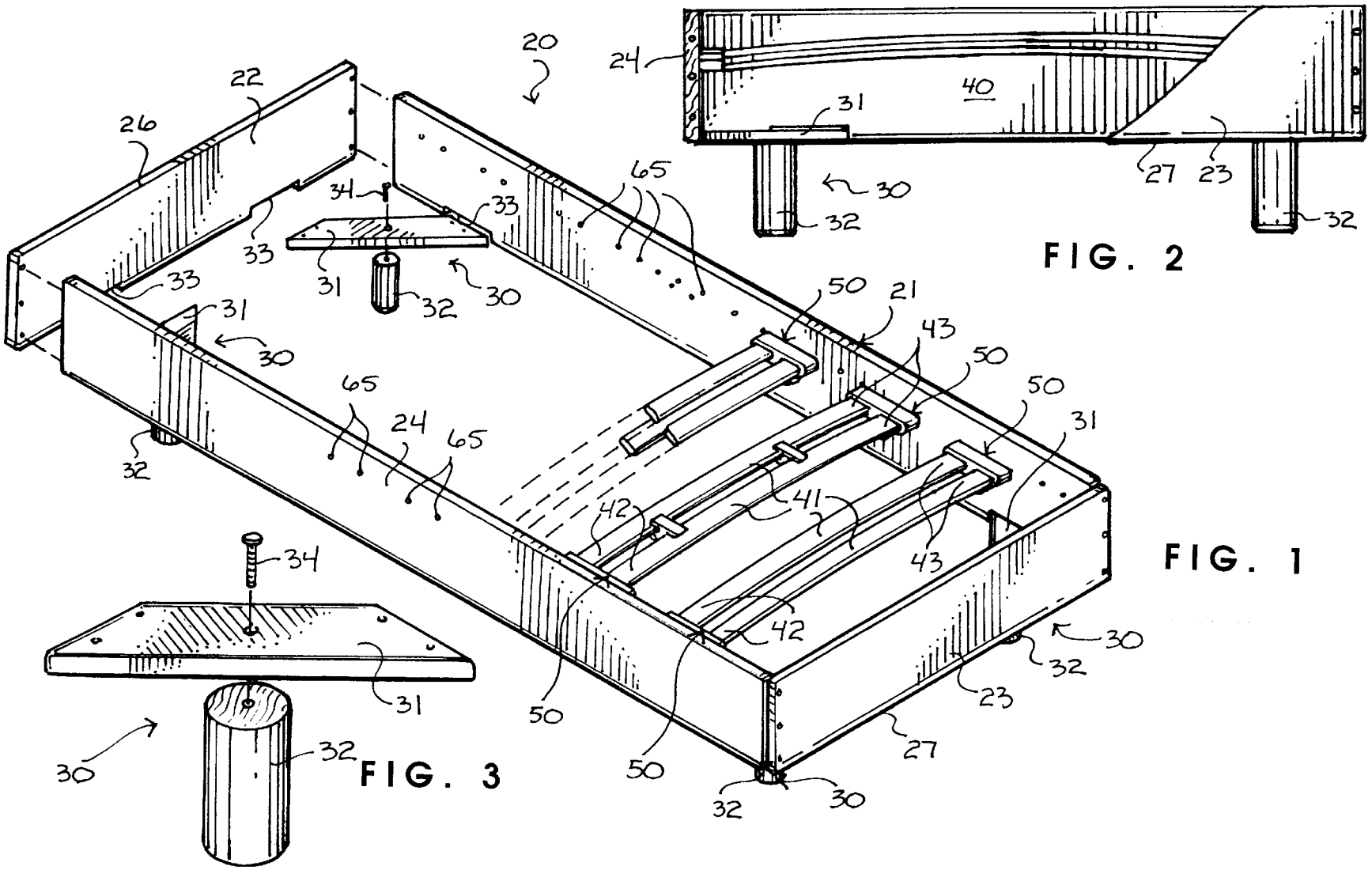
FIG. 1 illustrates a fragmented, partially exploded perspective view of a support assembly, in accordance with the present invention.
FIG. 2 illustrates a side elevational view of the support assembly of FIG. 1, portions therein being broken away for the purposes of illustration.
FIG. 3 illustrates an exploded perspective view of a leg assembly of the support assembly of FIG. 1.

Turning now to the drawings, FIG. 1 illustrates a fragmented, partially exploded perspective view of a support assembly 20, in accordance with the present invention. Support assembly 20 is generally comprised of a framework 21 including first and second end support members 22 and 23 and first and second elongate side support members 24 and 25. Preferably constructed of wood, a selected metal or other substantially rigid material, ends of first end support member 22 and ends of second end support member 23 are each engagable, such as with screws or other suitable mechanical fastening mechanism, with ends of first and second side support members 24 and 25 to form framework 21 having, in this specific example, a substantially rectangular or box shape as shown. So constructed, framework 21 is generally intended to have a first end 26 and a second end 27.

To provide support above the ground, support assembly 20 may further include a plurality of leg assemblies each being generally designated by the reference character 30. Referring momentarily to FIG. 3 illustrating an exploded perspective view of one of the plurality of leg assemblies 30, each leg assembly 30 is generally comprised of a leg support member 31 engagable with framework 21 and a leg 32 engagable with leg support member 31. In this regard, and with attention directed back to FIG. 1, ends of each leg support member 31 may be coupled, such as with one or more screws 34 as shown or other suitable detachably engagable mechanical engagement mechanism, with adjoining end and side support members of framework 21. A leg 32 may then be coupled, such as with screws, etc., with a corresponding leg support member 31 in downwardly depending relation for engagement with a supporting surface for supporting framework 21 above the supporting surface as shown substantially in FIG. 2. As a matter of preference, each end and side support member 22, 23, 24 and 25 may be formed with one or more grooves, each designated at 33, for accommodating or otherwise receiving the ends of the leg support members 31 if so desired at each corner or framework 21.

Regarding FIGS. 1 and 2, framework 21 bounds a space 40 and provides support for a plurality of slats proximate space 40 aligned substantially from first end 26 to second end 27, each slat being generally designated by the reference character 41. In a further and more specific aspect, slats 41 are engagable at first and second ends 42 and 43 thereof for support with the opposing first and second side support members 24 and 25 in substantially parallel and spaced-apart relation via coupler assemblies engagable with the opposing first and second side support members 24 and 25, each being generally designated by the reference character 50.

Figure 4:
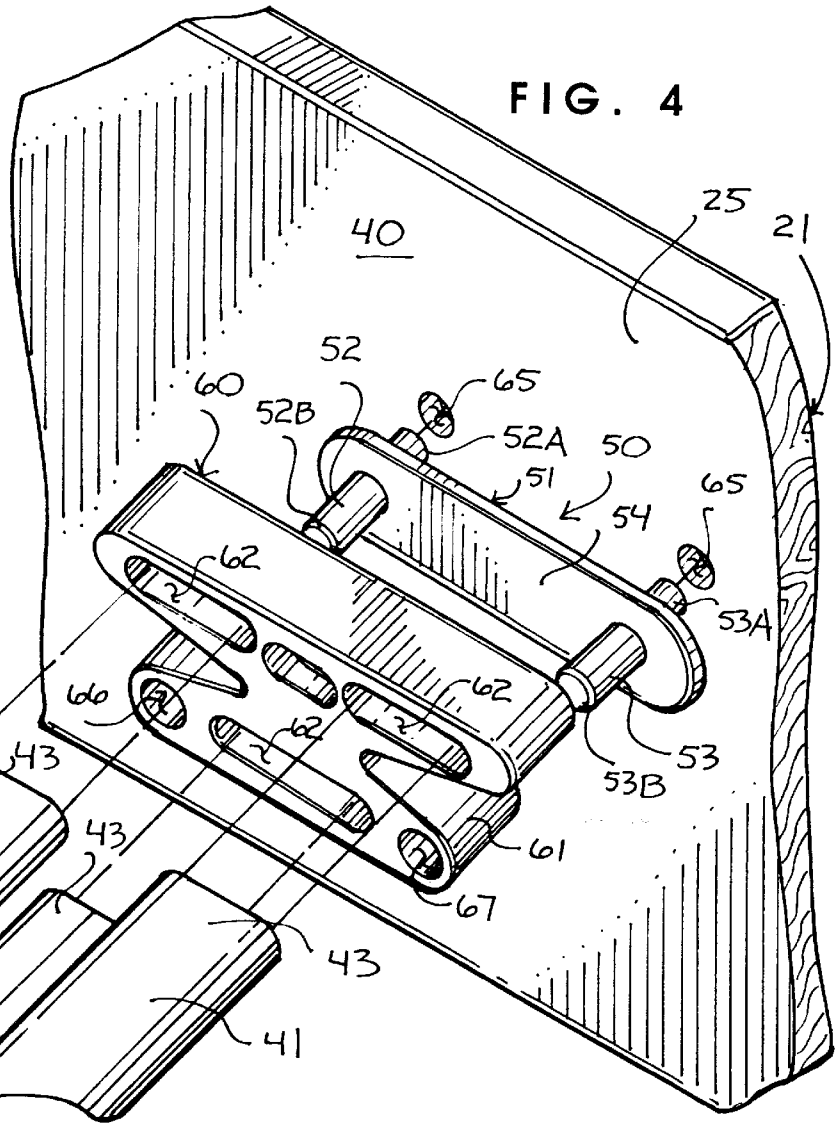
FIG. 4 illustrates a perspective view of a coupler assembly for providing engagement and support of one or more of a plurality of slats of the support assembly of FIG. 1.

With attention directed to FIG. 4, and preferably constructed of wood, plastic, metal or other substantially rigid material, each coupler assembly 50 is generally comprised of a supporting element 51 including a pair of pins 52 and 53 supported in spaced apart and substantially parallel relation with an elongate body 54, each pin 52 and 53 having first and second free ends 52A and 52B, and 53A and 53B, respectively, on either side of the elongate body 54. Further included is a coupler 60 including a body 61 having, in this specific example, a plurality of recesses 62 each for receiving an end, such as second end 43 as shown, of each one of a plurality of slats 41.

In operation, first free ends 52A and 53A are removably receivable by through holes 65 formed through, as shown for the purposes of illustration, second side support member 25. Extending inwardly toward space 40 bound by framework 21, second free ends 52B and 53B are each removably receivable by spaced-apart apertures 66 and 67 carried and formed with body 61 of coupler, with recesses 62 each available for removably receiving, in this specific example, a second end 43 of one of a plurality of slats 41.

Although not shown, another coupler assembly 50 may also be provided with first side support member 24 for providing the desired engagement of the opposing first ends 42 and support of slats 41 with framework 21 as shown substantially in FIG. 1. Furthermore, body 61 of coupler 60 is specifically provided with three recesses 62 operative for supporting three slats 41 in a substantially triangular orientation. However, body 61 may be implemented for supporting one or another selected plurality of slats 41 depending on specific needs without departing from the invention.

As shown in FIG. 1, a selected plurality of coupler assemblies 50 may be provided for engagement with a corresponding plurality of through holes 65 formed through the first and second side support members 24 and 25 from first end 26 to second end 27 of framework 21 for supporting a selected plurality of slats 41 at space 40. In this manner of assembly, slats 41 are operative for receiving and supporting a body supporting element (not shown), such as a conventional mattress, having a body supporting surface for supporting a human body for sleep, rest, etc. In this regard, framework 21 may be sized specifically for receiving varying sizes of mattresses such as, for instance, a single-, ½ queen- or twin- size mattress. To remove slats 41 and each coupler assembly 50, the foregoing operation need only be reversed.

Figure 6:
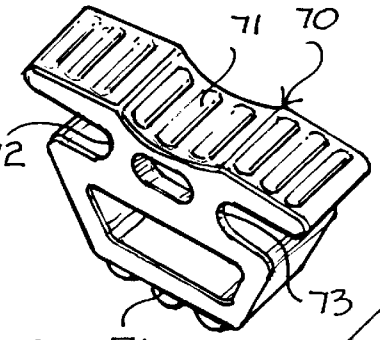
FIG. 6 illustrates an enlarged perspective view of the adjustment element of FIG. 5.
Figure 5:
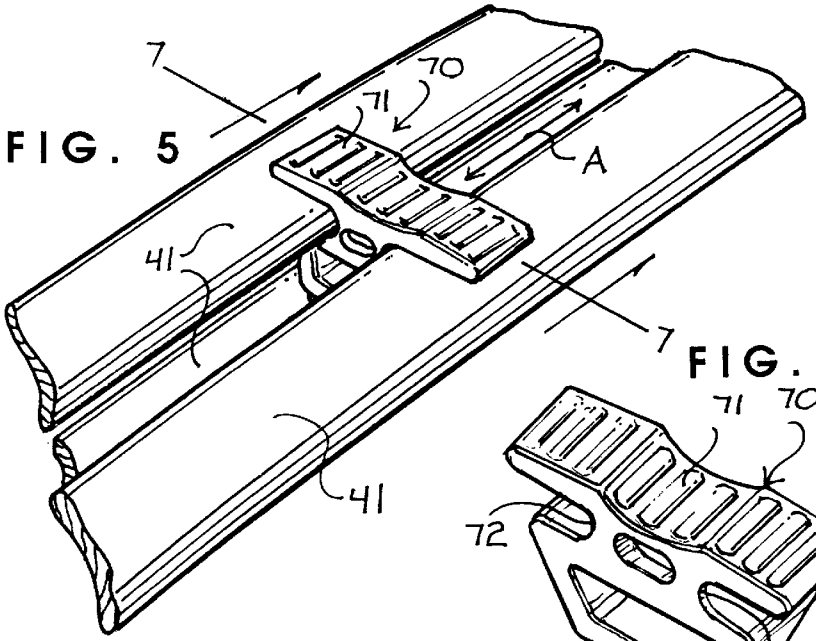
FIG. 5 illustrates a fragmented perspective view of a plurality of slats of the support assembly of FIG. 1, and further illustrating an adjustment element adjustably mounted therewith.
Figure 7:
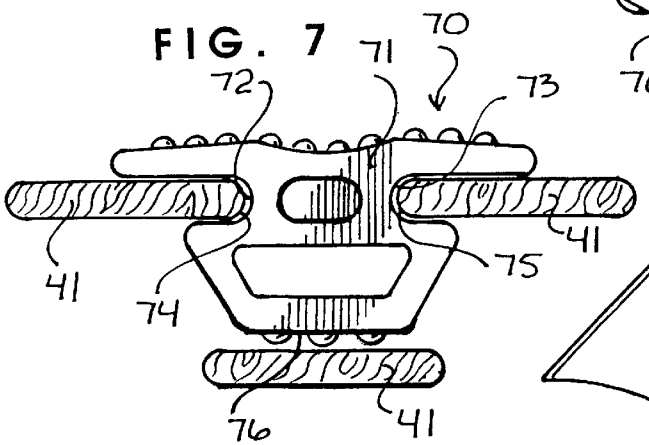
FIG. 7 illustrates a vertical sectional view taken along line 7—7 of FIG. 5.

With momentary reference to FIGS. 5 and 7, shown is the substantially triangular orientation of slats 41 as they would appear supported by opposing coupler assemblies 50 consistent a specific embodiment. Shown for the purposes of illustration is an adjustment element 70 captured by slats 41 for sliding movement in reciprocal directions as indicated by the double arrowed line A for allowing a user to adjust the firmness of each series of three slats 41. In this regard, adjustment element 70, of which is also shown in FIG. 6, is generally comprised of a body 71 having opposing ways or grooves 72 and 73 for receiving opposing edges 74 and 75 of adjacent and opposing ones of slats 41 and a free end 76 for sliding receipt against the lowermost one of the plurality of slats 41. By positioning adjustment element 70 at one or more selected locations via sliding movement along the length of slats 41 substantially from first ends 42 to second ends 43, the firmness slats 41 cooperate to exhibit may be adjusted as desired.

Consistent with the present invention, it may be desirable to couple a pair of support assemblies 20 together to form a bigger support assembly. In a further and more specific aspect, a pair of support assemblies, each of substantially identical construction to support assembly 20, may be coupled together to form another support assembly operative for receiving and supporting a mattress or other body supporting element, or a plurality of mattresses or body supporting elements, defining a body supporting surface greater than the body supporting surface of each body supporting element receivable and supportable by either one of the previously separate support assemblies. To this end, the desired construction of support assembly 20 to accommodate, for instance, a single-, ½ queen-, or twin-size mattress allows a user to couple a pair of support assemblies together to accommodate, for instance, a queen- or king-size mattress, or a plurality of one or more mattresses of a group including single-, ½ queen- and twin-size mattresses.

Figure 8:
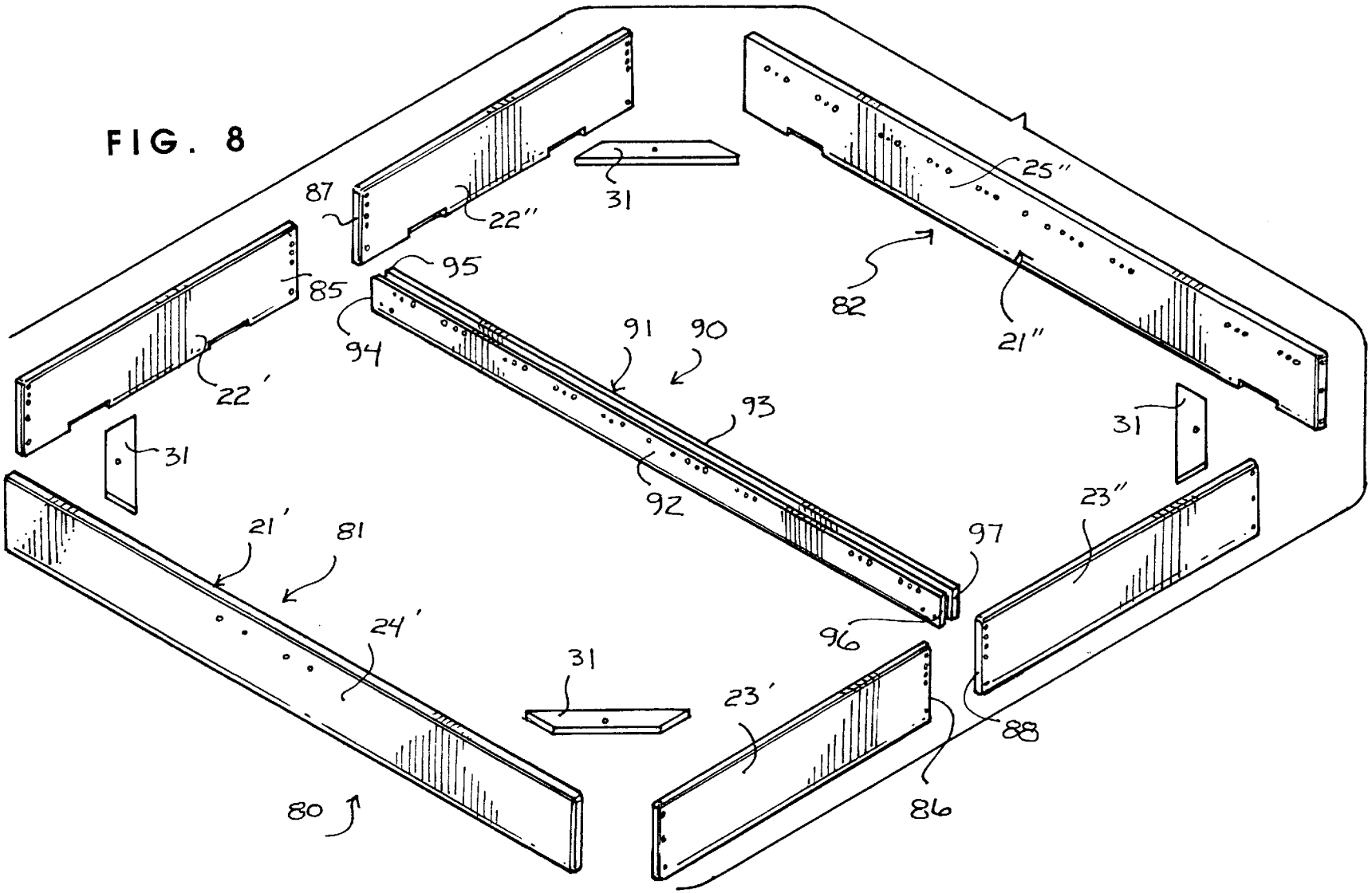
FIG. 8 illustrates an exploded perspective view of another embodiment of a support assembly, the support assembly including a connector assembly for interconnecting a pair of opposing frameworks, in accordance with the present invention.

To this end, and with attention directed to FIG. 8, illustrated is an exploded perspective view of another embodiment of a support assembly generally designated by the reference character 80. Support assembly 80 is generally comprised of a joining of first and second support assemblies 81 and 82 of identical construction to support assembly 20 previously discussed. In this regard, the same general reference characters set forth to describe the various structural features of support assembly 20 will also be used to describe the structural features of first and second support assemblies 81 and 82 as set forth in the ensuing discussion of FIGS. 8–10. However, in the interests of clarity, reference characters used to describe the first and second support assemblies 81 and 82 common to support assembly 20 will include prime ("') and double prime ("") symbols, respectively.

Consistent with the foregoing, support assembly 81 is generally comprised of a first framework 21'. First framework 21' includes first and second end support members 22' and 23' and a first side support member 24', second side support member (corresponding to second side support member 25) having been removed to expose free ends of first and second end support members 22' and 23'. The leg assemblies (not shown) are intended also to have been removed from the second side support member and the first and second end support members 22' and 23'. For the purposes of orientation, the free ends of first and second end support members 22' and 23' are herein defined as first and second free ends 85 and 86 of support assembly 81.

Support assembly 82 is generally comprised of a second framework 21". Second framework 21" includes first and second end support members 22" and 23" and a second side support member 25", first side support member (corresponding to first side support member 24) having been removed to expose free ends of first and second end support members 22" and 23". The leg assemblies (not shown) are intended also to have been removed from the first side support member and the first and second end support members 22" and 23". For the purposes of orientation, the free ends of first and second end support members 22" and 23" are herein defined as first and second free ends 87 and 88 of support assembly 82.

To couple first and second support assemblies 81 and 82 together, provided is a connector assembly 90 operative for engaging together the first free ends 85 and 87 and the second free ends 86 and 88 of first and second support assemblies 81 and 82, and for providing structural support for slats (not shown). Connector assembly 90 is generally comprised of an elongate support structure 91 shown, in this specific example, as first and second substantially coextensive support elements 92 and 93 each having a forward end 94 and 95 and a rearward end 96 and 97. With attention directed to FIG. 9, first and second support elements 92 and 93 are engagable at forward ends 94 and 95 with first end support members 22' and 22" at first free ends 85 and 87 of first and second frameworks 21' and 21" in substantially perpendicular relation via screws 98 as shown, or other suitable detachably engagable mechanical engagement mechanism. Although not shown, first and second support elements 92 and 93 are also engagable at rearward ends 96 and 97 with second end support members 23' and 23" at second free ends 86 and 88 of first and second frameworks 21' and 21" in substantially perpendicular relation via screws, or other suitable detachably engagable mechanical engagement mechanism. To then secure first and second frameworks 21' and 21" together, first and second support elements may be engaged together in substantially coextensive, opposing and substantially parallel relation to thus join together first free ends 85 and 87 and second free ends 86 and 88. In this manner of assembly, first and second frameworks 21' and 21" cooperate to define a support assembly suitable for supporting one or more mattresses or body supporting elements having a total body supporting surface greater than the body supporting elements previously receivable and supportable by either one of the first or second support assemblies 81 or 82 alone.

To provide support assembly 80 with an infrastructure suitable for supporting one or more body supporting elements, slats 41 (not shown) may be mounted for support at their first and second ends via coupler assemblies 50 (not shown) with first side support member 24' and first support element 92 of connector assembly 90, and with second side support member 25" and second support element 93 of connector assembly 90.

Figure 9:
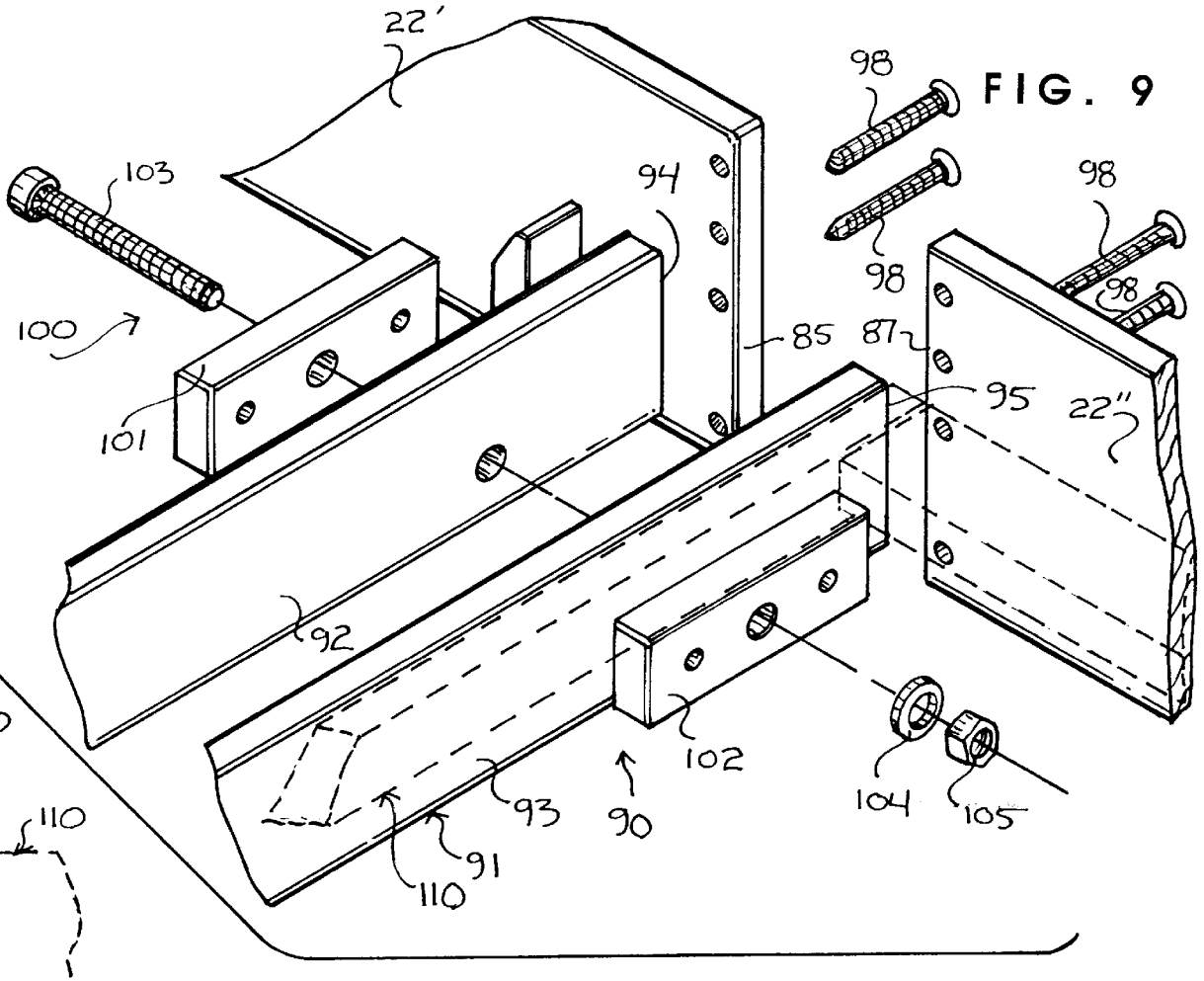
FIG. 9 illustrates an exploded fragmented perspective view of portions of the connector assembly and the pair of opposing frameworks of FIG. 8.
Figure 10:
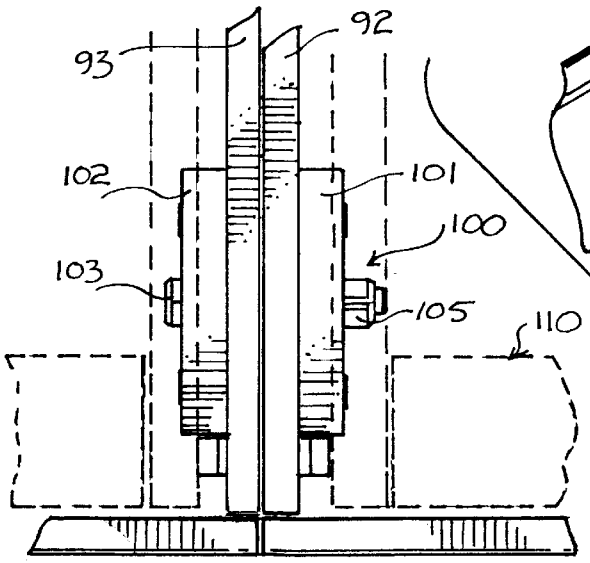
FIG. 10 illustrates an end elevational view of the connector assembly of FIG. 9 as it would appear assembled.

To interconnect the first and second support elements 92 and 93 together, FIG. 9 illustrates an engagement assembly 100 including, in a specific example, a pair of blocks 101 and 102 positioned outboard of a respective one of the first and second support elements 92 and 93. Further included is a bolt 103 receivable into and through through-holes formed through the blocks 101 and 102 and first and second support elements 92 and 93, a washer 104 and a nut 105 threadably engagable with the bolt 103 for securing together and capturing washer 104, the blocks 101 and 102 and the first and second support elements 92 and 93 therebetween, the configuration of which may be easily be seen in FIG. 10. A selected plurality of engagement assemblies 100 may be provided in spaced apart relation along substantially the entire length of first and second support elements 92 and 93 as desired for securing the first and second support elements 92 and 93 together. Furthermore, blocks 101 and 102, although not essential for providing engagement of the first support element 92 with the second support element 93, are provided to give support to an adjustable support assembly 110 shown generally in the dotted outline in FIGS. 9 and 10, further details to be discussed presently.

Figures 11, 12:
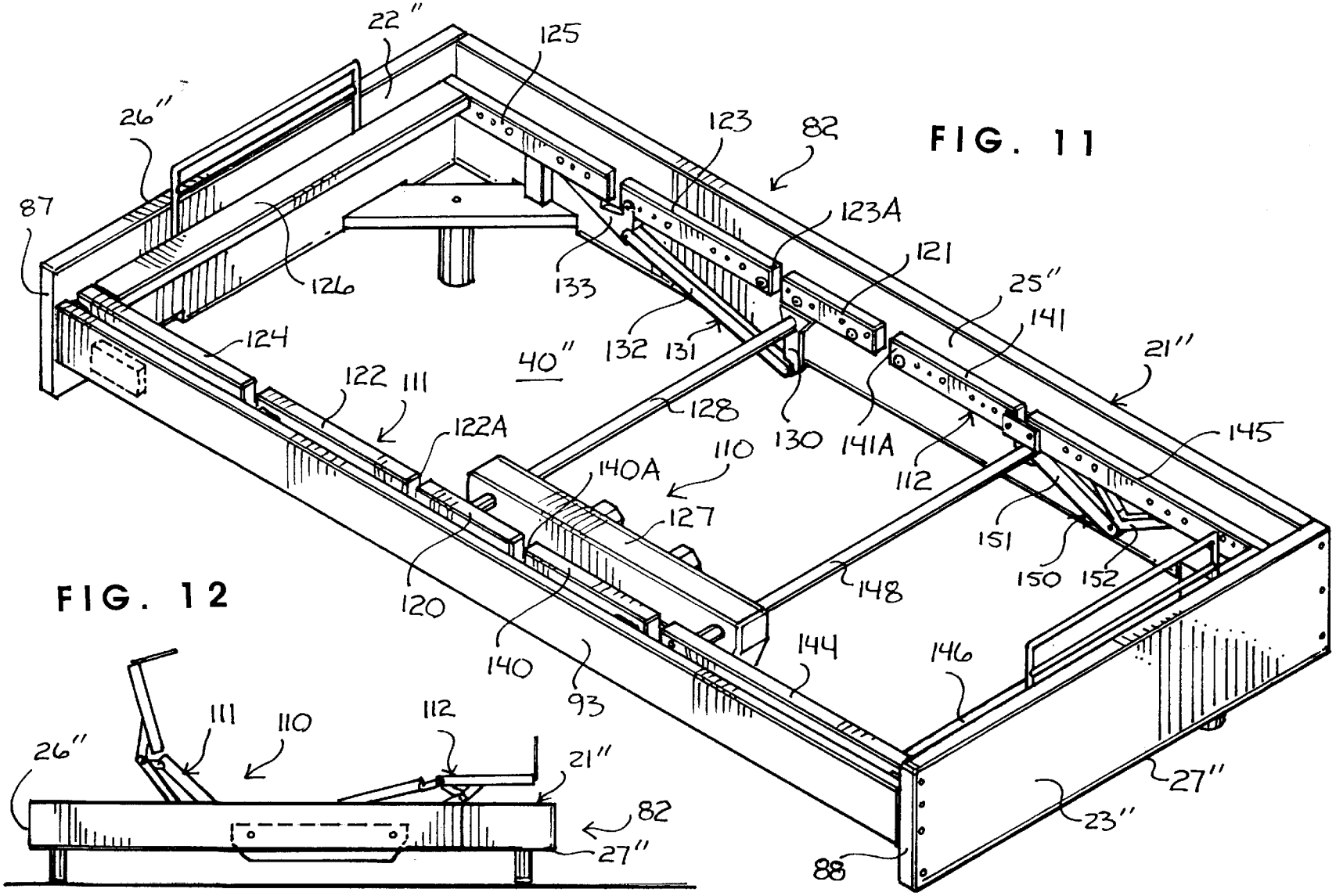
FIG. 11 illustrates an exploded perspective view of yet another embodiment of a support assembly, the support assembly including an adjustable support assembly carried by a framework, the adjustable support assembly shown as it would appear in a lowered orientation, in accordance with the present invention.
FIG. 12 illustrates a side elevational view of the support assembly of FIG. 11, the adjustable support assembly shown as it would appear in an elevated orientation.

Because the slats 41 of the present invention have been disclosed as removably engagable with support assemblies 20 and 80, they may be removed and in their place, adjustable support assembly 110 installed or otherwise secured therewith such as with screws, bolts or other suitable detachably engagable mechanical fasteners. Referring now to FIG. 11, shown for the purposes of discussion in this regard is second support assembly 82 of support assembly 80 as it would appear assembled including first and second end support members 22" and 23", second side support member 25" and second support element 93 of connector assembly 90, all shown as they would appear interconnected in the manner discussed previously in combination with FIGS. 8–10. For the purposes of orientation, framework 21" of support assembly 82 is generally intended to include first end 26" and second end 27". In the interests of clarity, adjustable support assembly 110 may be coupled with framework 21 of support assembly 20 or with framework 21' of support assembly 81 in a manner substantially similar to that of the ensuing discussion. In this regard, rather than coupling adjustable support assembly 110 with second side support member 25" and second support element 93 of support assembly 82 to be discussed presently, adjustable support assembly 110 may be coupled with first and second side support members 24 and 25 of support assembly 20, and with first side support member 24' and first support element 92 of support assembly 81 if desired.

Adjustable support assembly 110 is engagable with framework 21" proximate space 40" intermediate first and second ends 26" and 27" and is movable between a lowered orientation as shown in FIG. 11 and an elevated orientation as shown in FIG. 12. Assembly 110 is operative for receiving and supporting an adjustable body supporting element or mattress much like the conventional adjustable mattresses found with conventional adjustable beds commonly found in hospitals, retirement homes, etc.

In this specific embodiment, adjustable support assembly 110 is generally comprised of first and second linkage assemblies 111 and 112, first linkage assembly 111 being directed toward first end 26", and second linkage assembly 112 being directed toward second end 27". First linkage assembly 111, of which is designed for accommodating the upper torso of the human body, includes first and second braces 120 and 121 engagable via screws or other suitable detachably engagable mechanical fasteners with second support element 93 and second side support member 25" in substantially opposing relation. Also included are opposing first linkage elements 122 and 123 each having and end 122A and 123A mounted with framework 21" as shown toward first end 26" for pivotal movement, and opposing pivotally attached second linkage elements 124 and 125 terminating with free ends connected with an elongate member 126.

Although movement of first linkage assembly 111 between lowered and elevated orientations may be carried out manually, a motor 127 may be employed as shown. In this regard, motor 127, which may be provided as a conventional electric motor having either a self-contained power source or a power cord (not shown) for coupling with a conventional power outlet, is operative for actuating a first axle 128 for rotation in one or more predetermined directions for moving first linkage assembly 111 between lowered and elevated orientations.

To transfer movement of first axle 128 to first linkage assembly 111 in this regard, first axle 128 is coupled with first brackets 130 (only one shown) of a link assembly 131, each first bracket 130 being mounted for pivotal movement at an end with one of the first and second braces 120 and 121. Link assembly 131 further includes arms 132 (only one shown) each mounted for pivotal movement with another end of one of brackets 130 and with one of second bracket 133. Ends of first linkage elements 122 and 123 confronting ends of second linkage elements 124 and 125, respectively, are each mounted with one of second brackets 133 for pivotal movement, and ends of second linkage elements 124 and 125 confronting ends of first linkage elements 122 and 123, respectively, are in turn substantially rigidly mounted with a corresponding one of second brackets 133. Rotation of first axle 128 in predetermined directions upon selected actuation of motor 127 may be initiated for moving first linkage assembly 111 between the lowered orientation as set forth in FIG. 11, and the elevated orientation as set forth in FIG. 12.

Second linkage assembly 112 includes opposing first linkage elements 140 and 141 having ends 140A and 141A mounted with framework 21" as shown toward second end 26" for pivotal movement and opposing pivotally attached second linkage elements 144 and 145 terminating with free ends connected with an elongate member 146. Although movement of second linkage assembly 112 between lowered and elevated orientations may be carried out manually like first linkage assembly 111, motor 127 may be employed as shown. In this regard, motor 127 may also be implemented for actuating a second axle 148 for rotation in one or more predetermined directions for moving second linkage assembly 112 between lowered and elevated orientations, second axle 148 being spaced from first axle 128.

To transfer movement of second axle 148 to second linkage assembly 112 in this regard, second axle 148 is coupled with a link assembly 150 and, more particularly, to arms 151 (only one shown) of link assembly 150. Each arm 151 is in turn mounted for pivotal movement at a free end thereof with a bracket 152 (only one shown) each fixed with one of the second linkage elements 144 and 145. Rotation of second axle 148 in predetermined directions upon selected actuation of motor 127 may be carried out for moving second linkage assembly 112 between the lowered orientation as set forth in FIG. 11, and the elevated orientation as set forth in FIG. 12.

In summary, the present invention provides modular and interconnectable components suitable for allowing conversion of a support assembly from a first orientation for supporting one of a single-, ½ queen- and twin-size mattress, to a second orientation for supporting one of a queen- and king-size mattress, or perhaps a plurality of single-, ½ queen- and twin-size mattresses. The slats herein disclosed for providing selected support may be removed, in addition to the corresponding coupler assembly 50, for allowing the easy installation of an adjustable support assembly as desired in the various embodiments.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. In a first body supporting element having a supporting surface, a second body supporting element having a supporting surface and a third body supporting element having a supporting surface greater than the supporting surface of each of the first and second body supporting elements, a modular support system comprising:

a first framework having ends and a removable first support member;

a second framework having ends and a removable second support member;

a first plurality of slats; and a second plurality of slats;

the modular support system movable between first and second conditions, the first condition comprising:

the first framework engaged to the first plurality of slats for supporting the first body supporting element, and the second framework engaged to the second plurality of slats for supporting the second body supporting element; and with the first support member removed from the first framework and the second support member removed from the second framework, the second condition comprising:

a connector assembly interconnecting the first framework with the second framework and each cooperating together supporting the first and second pluralities of slats for receiving and supporting the third body supporting element, the connector assembly comprising a plurality of separate elongate elements each corresponding to one of the first and second frameworks, wherein one of the elongate elements includes ends engaged to the ends of one of the first and second frameworks and the other of the elongate elements includes ends engaged to the ends of the other of the first and second frameworks.

2. The modular support system of claim 1, further including means for engaging the ends of the elongate elements of the connector assembly to the ends of the first and second frameworks.

3. The modular support system of claim 1, further including means for engaging each one of the first and second plurality of slats to one of the elongate elements of the connector assembly.

4. In a first body supporting element having a supporting surface, a second body supporting element having a supporting surface, a third body supporting element having a supporting surface greater than the supporting surface of each of the first and second body supporting elements and an adjustable body supporting element, a modular support system comprising:

a first framework having ends and a removable first support member;

a second framework having ends and a removable second support member;

a first plurality of slats;

a second plurality of slats;

an adjustable support assembly; and a connector assembly including a plurality of separate elongate elements each having ends;

the modular support system movable between first, second and third conditions, the first condition comprising:

the first framework engaged to the first plurality of slats for supporting the first body supporting element, and the second framework engaged to the second plurality of slats for supporting the second body supporting element;

with the first support member removed from the first framework and the second support member removed from the second framework, the second condition comprising:

the connector assembly interconnecting the first framework with the second framework, the first and second frameworks cooperating together supporting the first and second pluralities of slats for receiving and supporting the third body supporting element, wherein one of the elongate elements includes ends engaged to the ends of one of the first and second frameworks and the other of the elongate elements includes ends engaged to the ends of the other of the first and second frameworks; and with the first support member removed from the first framework and the second support member removed from the second framework, the third condition comprising:

the connector assembly interconnecting the first framework with the second framework, the first and second frameworks cooperating together supporting one of the first and second pluralities of slats for receiving and supporting one of the first and second body supporting elements and for receiving and supporting the adjustable e support assembly for receiving and supporting the adjustable body supporting element.

5. The modular support system of claim 4, further including means for engaging the ends of the elongate elements of the connector assembly to the ends of the first and second frameworks.

6. The modular support system of claim 4, further including means for engaging each one of the first and second plurality of slats to one of the elongate elements of the connector assembly.

7. The modular support system of claim 4, wherein the adjustable support assembly comprises:

a first linkage assembly engagable to the framework for movement between a lowered orientation and an elevated orientation; and means for moving the first linkage assembly between the lowered orientation and the elevated orientation.

8. The modular support system of claim 7, wherein the adjustable support assembly further includes:

a second linkage assembly engagable to the framework for movement between a lowered orientation and an elevated orientation; and means for moving the second linkage assembly between the lowered orientation and the elevated orientation.

* * * * *